US008171865B2

(12) United States Patent
Lindskog et al.

(10) Patent No.: US 8,171,865 B2
(45) Date of Patent: May 8, 2012

(54) METHOD AND DEVICE RELATED TO AN ALARMED VALUE SPACE

(75) Inventors: Kjell Lindskog, Skelleftea (SE); Per Forsman, Skelleftea (SE)

(73) Assignee: SQS Security Qube System AB, Skelleftea (SE)

( * ) Notice: Subject to any disclaimer, the term of this patent is extended or adjusted under 35 U.S.C. 154(b) by 518 days.

(21) Appl. No.: 11/792,785

(22) PCT Filed: Dec. 3, 2005

(86) PCT No.: PCT/SE2005/001832

§ 371 (c)(1),
(2), (4) Date: Mar. 18, 2008

(87) PCT Pub. No.: WO2006/062462

PCT Pub. Date: Jun. 15, 2006

(65) Prior Publication Data

US 2008/0257232 A1 Oct. 23, 2008

(30) Foreign Application Priority Data

Dec. 9, 2004 (SE) ..... 0403007

(51) Int. Cl.
*E05G 1/00* (2006.01)

(52) U.S. Cl. ..... 109/25; 109/29; 109/31; 109/38; 194/208

(58) Field of Classification Search ..... 109/25, 109/29–34, 38–44; 194/206–208; 209/534; 271/216, 176; 242/528
See application file for complete search history.

(56) References Cited

U.S. PATENT DOCUMENTS

| | | | | |
|---|---|---|---|---|
| 1,266,353 | A * | 5/1918 | Trantham | 109/33 |
| 4,337,864 | A * | 7/1982 | McLean | 209/534 |
| 4,607,579 | A | 8/1986 | Stenild | |
| 5,495,929 | A * | 3/1996 | Batalianets et al. | 194/207 |
| 5,616,915 | A * | 4/1997 | Simpkins et al. | 250/221 |
| 6,497,186 | B1 * | 12/2002 | Lundblad | 109/25 |
| 6,564,726 | B1 | 5/2003 | Lindskog | |
| 7,100,520 | B2 * | 9/2006 | Abe et al. | 109/25 |
| 2004/0007165 | A1 | 1/2004 | Abe et al. | |
| 2006/0163030 | A1 * | 7/2006 | Izawa et al. | 194/350 |
| 2006/0272921 | A1 * | 12/2006 | Chien et al. | 194/207 |

FOREIGN PATENT DOCUMENTS

| | | |
|---|---|---|
| FR | 2858005 | 1/2005 |
| WO | 9009504 | 8/1990 |
| WO | 03089745 | 10/2003 |

* cited by examiner

*Primary Examiner* — Lloyd Gall
(74) *Attorney, Agent, or Firm* — Mark P. Stone

(57) ABSTRACT

A method and an arrangement for defacing and/or destroying items stored in an alarmed value space (30), wherein there is used a piercable or openable container (80) that contains a defacing agent/destructive agent (C). When an alarm is triggered, the defacing agent/destructive agent (C) is distributed in the value space (30) while, at the same time, reducing the combined volume of the container (80) and the value space (30). The arrangement (50) includes a container (80) which contains defacing agent/destructive agent (C) and an element (62, 63) for piercing or opening the container (80) in conjunction with triggering of the alarm. The arrangement (50) also includes a spring activated press element or press plate (71) and an element (75, 76) for causing the press element/press plate (71) and the piercing element or opening element (62, 63) to move in response to triggering of the alarm. The arrangement can be used effectively in all working directions relative to the value space.

20 Claims, 4 Drawing Sheets

METHOD AND DEVICE RELATED TO AN ALARMED VALUE SPACE

BACKGROUND OF THE INVENTION

The present invention relates to a method of defacing, such as marking or staining, and/or destroying items stored in an alarmed value space. The invention also relates to an arrangement and to a use.

In respect of spaces for storage of valuables, for instance banknotes, cheques and other types of items there is a need of rendering such items useless when an attempt is made to break into the space unlawfully.

WO 99/61741 and WO 03/089745 exemplify earlier known methods and arrangements in the aforesaid technical field.

These earlier publications describe the distribution of a document defacing agent/document destruction agent whose activation is dependent on the force of gravity to a great extent. This means that a user is dependent on maintaining the orientation of the document accommodating space in order to obtain an optimum defacing effect/destruction effect. Tilting/sloping of the document accommodating space can thus jeopardize the desired result if no defacing agent/destruction agent has had time to be distributed prior thereto.

SUMMARY OF THE INVENTION

One object of the present invention is to provide a method and an arrangement which, when necessary, will provide particularly effective defacing/destruction of items and articles stored in an alarmed valuable article accommodating space regardless of the position to which the space may be turned or of its orientation in space. This object is achieved with a method and an arrangement having the characteristic features set forth in the accompanying claims.

The advantages listed below are examples of the many advantages that are afforded by the present invention.

The design and construction of the inventive arrangement are such as to provide a very high degree of efficiency and will cause the space-accommodated items to be marked/destroyed regardless of the direction or attitude of the space, in other words regardless of the rotational position of the space. For instance the arrangement will function efficiently even when the space is turned upside down. No gravitational effect is required for distributing the item defacing/destroying agent.

A further significant benefit afforded by the invention is that the space is diminished in conjunction with the distribution of the defacing/destroying agent, meaning that the defacing agent/destroying agent will be concentrated on the valuable items regardless of the position to which the space is turned.

The use of an explosive device is not required and the inventive arrangement is extremely service friendly.

The inventive arrangement can also be readily adapted to suit different types of value spaces.

BRIEF DESCRIPTION OF THE DRAWINGS

The inventive arrangement also affords technical and economical advantages.

The invention will now be described more specifically by way of example and with reference to the accompanying drawings in which.

DESCRIPTION OF THE BEST MODES FOR CARRYING OUT THE INVENTION

Figure 1:
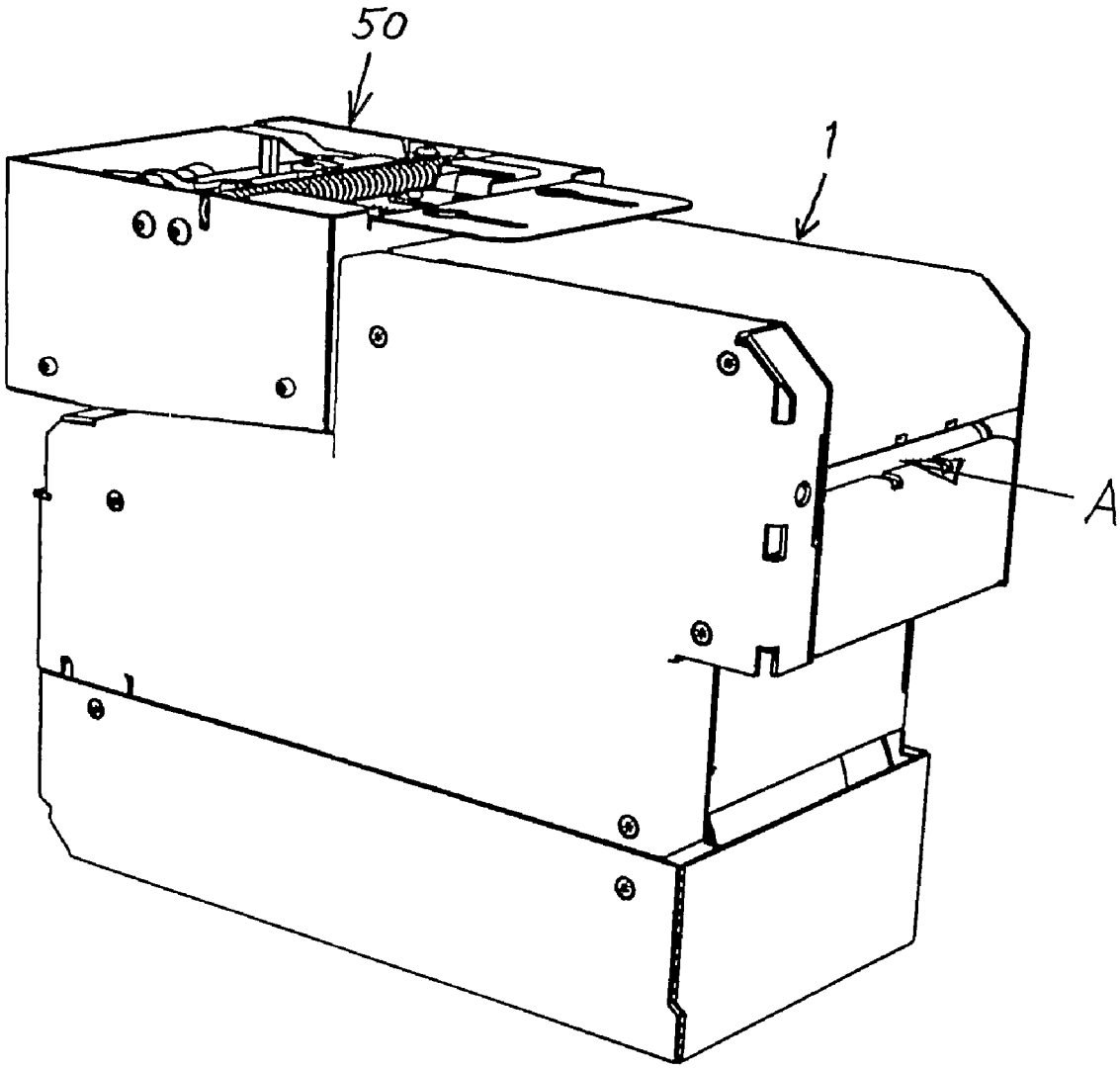
FIG. 1 is a perspective view of a valuable document unit that carries a staining unit.
Figure 2:
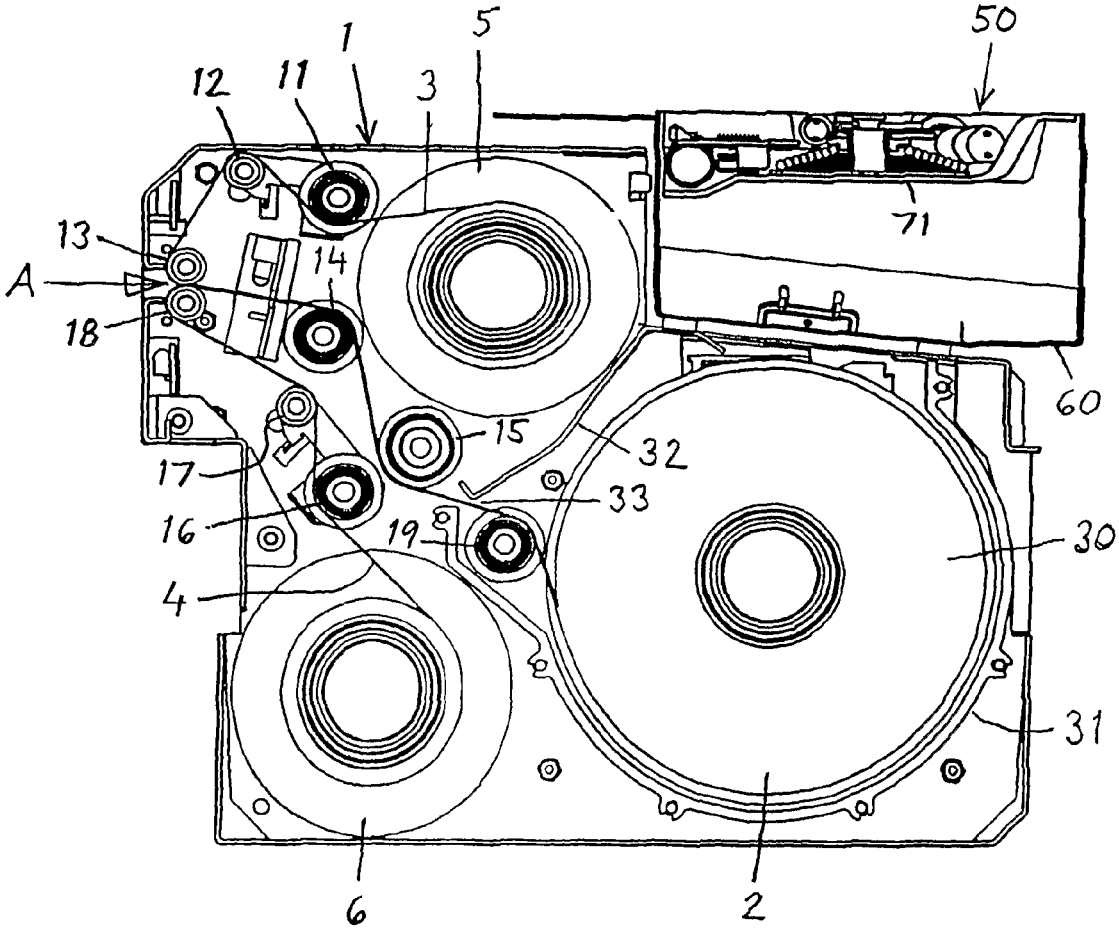
FIG. 2 is a longitudinally sectioned view of the arrangement shown in FIG. 1.
Figure 3:
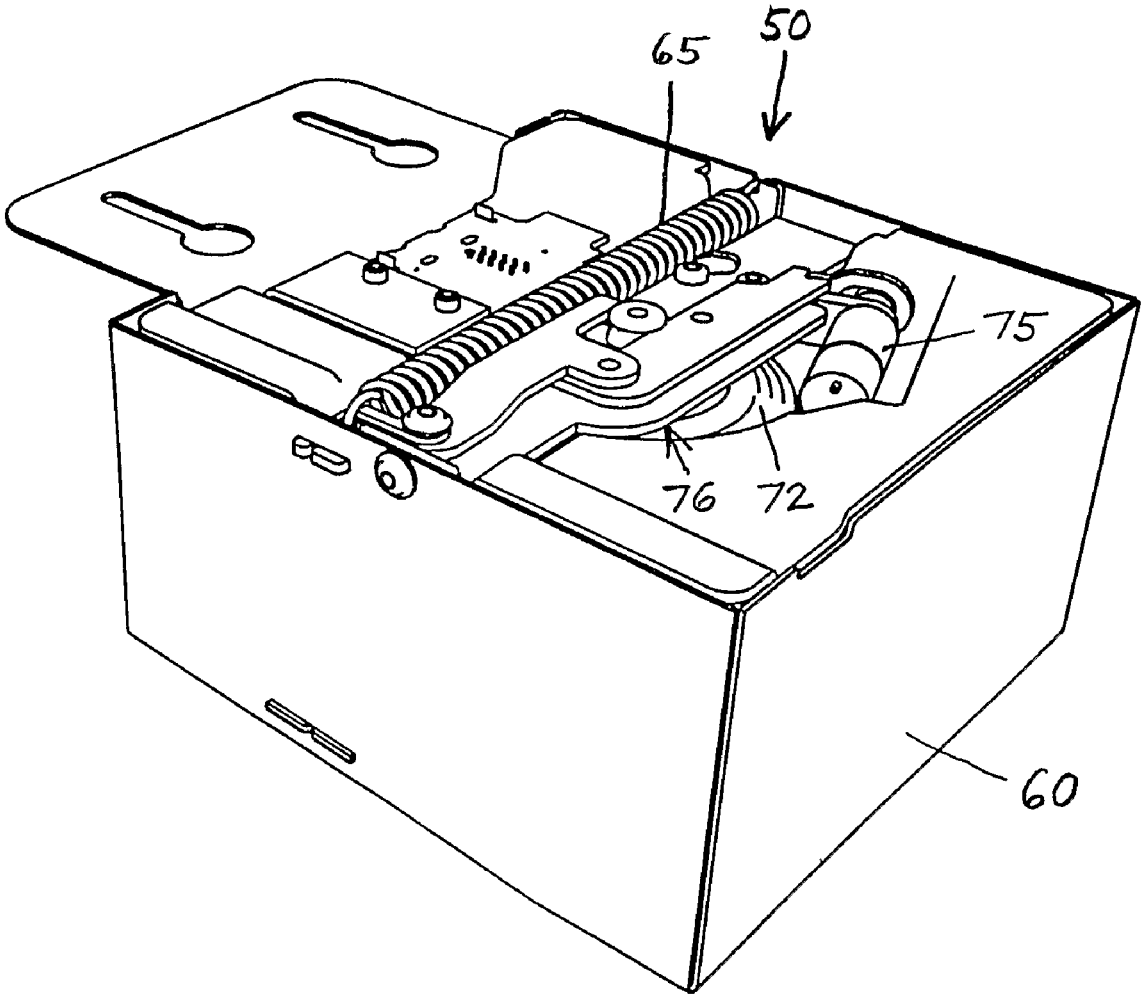
FIG. 3 is a perspective view of the staining unit.
Figure 4:
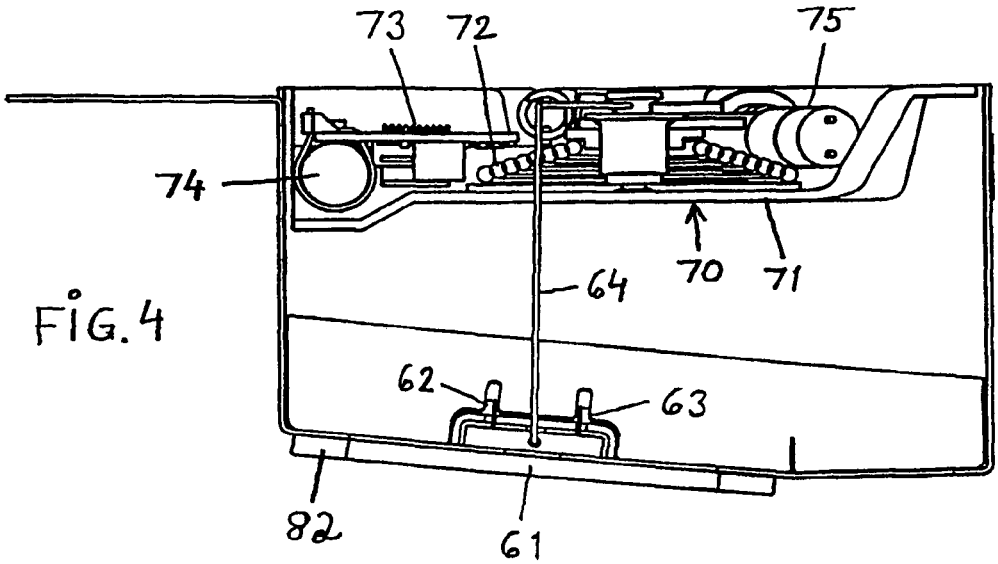
FIG. 4 is a longitudinally sectioned view of the staining unit.

FIGS. 1 and 2 illustrate a valuable document accommodating unit 1 that comprises a reversibly rotatable drum 2, wherein valuable items, for instance banknotes, can be wound onto and unwound from the drum with the aid of foil strips/carrier films. The valuable items concerned are wound onto the drum 2 by means of carrier film or foil 3,4 stored on reversibly rotatable carrier rollers 5,6. As will be evident from FIG. 2, the requisite control of the carrier films 3,4 is achieved by means of guide rollers 11-19. As indicated by the arrow A, the valuable items/banknotes are fed in between the carrier films 3,4 and wound onto the drum 2 together with the carrier films 3,4. The banknotes are discharged from the drum 2, by reversing the direction of rotation of the drum 2 and the rollers 5,6. A processor unit (not shown) is provided for monitoring, controlling and steering the value unit 1.

The unit 1 includes a value space 30. The value space 30 is disposed adjacent the drum 2 and is conforming generally to the shape of the drum exterior and therewith restrict the volume of the space that is intended to take-up a distributed defacing agent/destruction agent. The space 30 is delimited by a curved wall portion 31 and an angled wall portion 32. Defined between said wall portions 31,32 is a gap 33 for passage of the carrier films 3,4 and said banknotes to and from the drum 2. The value space 30 is delimited sideways by walls of the value unit 1. The space 30 includes upwardly an opening for docking with a staining unit/defacing unit/destruction unit 50.

As evident from FIGS. 1 and 2, the staining unit 50 can be connected to and docked with the value unit 1.

The staining unit 50 has a box-like design and comprises a casing 60 whose bottom part includes an opening 61 through which defacing agent/destruction agent is forced out into a value space. The staining unit 50 has disposed in its bottom region two cutting blades 62,63 which can be manoeuvred along the bottom surface of the casing 60 by means of a cable or wire arrangement 64 and a tension spring 65, said cutters functioning to puncture/slit when necessary a dye/colour container provided in the staining unit 50. When the blades 62,63 are in an inactive rest state, the blades are parked behind a blade guard 66 at the same time as the tension spring 65 is fixed in an extended position.

The staining unit 50 includes in its upper region an agent evacuating device 70 that includes a press plate 71 which is actuated by a conical pressure spring 72. The press plate 71 is shown in its upper end position in the figures, wherein the conical spring 72 is fixed in a compressed state. The press plate 71 is therewith parked in its starting position. The press plate 71 covers essentially the whole of the internal space of the casing 60, as evident from the figures.

The staining unit 50 includes a circuit board 73 with requisite electronic components, a power source 74 and an electric motor 75. The electric motor 75 is designed to release the compressed fixation of the pressure spring 72 and the withdrawn fixation of the tension spring 65 via a linkage system 76 in conjunction with an alarm. If desired, both springs can be released simultaneously or in a given sequence and with a chosen time displacement therebetween. It is beneficial, however, to design the linkage system so that the conical pressure spring 72 will be released somewhat prior to the release of the tension spring 65.

Furthermore, an alarm arrangement or an alarm system is adapted to detect an unlawful attempt to manipulate and access the staining unit and the valuable item unit.

Figure 5:
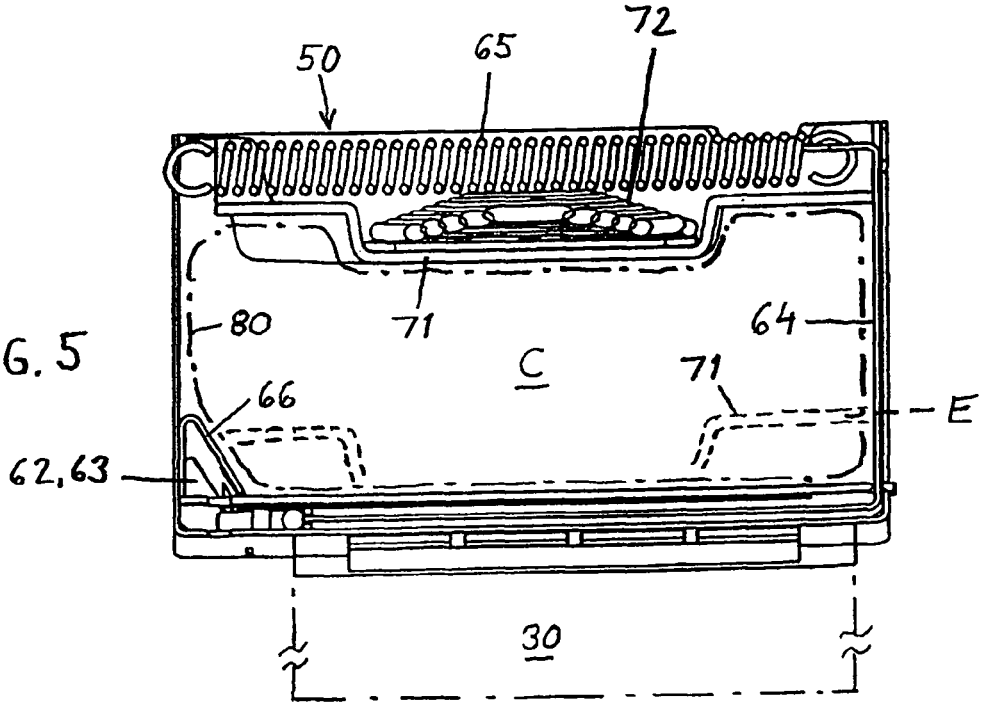
FIG. 5 is a cross-sectioned view of the staining unit.

When using the inventive arrangement the defacing/staining unit 50 and the valuable item containing unit 1 are mutually combined and docked. Moreover the staining unit 50 is charged with, for instance, a dye C or a defacing agent/destructive agent encapsulated in a plastic foil casing 80 or its like. The casing 80 enclosing the defacing agent is dimensioned to adequately fill the empty space found in the casing 60 when the press plate 71 is parked and fixated in its upper starting position. The foil casing 80 is shown in chain lines in FIG. 5.

The following events take place in response to an alarm. The electric motor 75 is activated so as to via the linkage system 76 cause the release of the fixated and compressed pressure spring 72, wherewith the spring is able to expand and move the press plate 71 for compression of the foil casing 80. Also the fixated and extended tension spring 65 is released via the linkage system 76, wherewith the tension spring 65 is able to contract and via the cable or wire arrangement 64 cause the blades 62,63 to move along the bottom surface of the casing 60 so as to slit the foil casing 80, wherewith defacing dye/medium is ejected or sprayed into the value space 30, therewith defacing or destroying the valuable items present in said space. The pressure spring 72 is dimensioned to provide a very powerful agent ejection at the same time as it moves the press plate 71 to a terminal position E indicated in broken lines in FIG. 5.

It will be understood that the inventive arrangement results in satisfactory staining/defacing/destruction of the space-accommodated items even when the arrangement is turned upside down. If for example the unit containing the valuable items is turned upside down the powerful ejection of staining fluid will effectively deface/destroy said valuable items. The press plate 71 remains in its end position E when ejection of the fluid is completed, thereby preventing fluid from running back into the unit 50 while ensuring that the dye/colour/agent will remain in the value space 30 so as to achieve a maximum defacing or destruction result. The inventive arrangement will thus function satisfactorily in all occurring working directions.

It will be understood that necessary seals are, of course, provided, such as the seal 82.

Thus, a central feature of the present invention is that when an alarm is triggered, the defacing agent/destruction agent will be distributed in the value space at the same time as the combined volume of the container 80 and the space 30 is reduced. This is made possible by causing the press plate 71 to compress the container 80 and to keep the container in its compressed state. Defacing agent/destructive agent C is prevented from running back into the container 80 by the fact that the communication opening between the container 80 and the space 30 will be essentially blocked.

It will be understood that the structural design of the inventive arrangement can be broadly varied within the scope of the inventive concept. For instance, the puncturing element may have many different forms.

It will also be understood that the inventive defacing arrangement may be capable of co-acting with and of being adapted to suit many different types of value spaces in addition to the space exemplified above.

It will therefore also be understood that the invention is not restricted to the illustrated and described arrangement and method and that modifications can be made within the scope of the accompanying claims.

The invention claimed is:

1. A method of defacing or destroying items stored on a drum (2) in an alarm-equipped value space (30) using a pierceable or openable container (80) that contains a defacing agent or a destructive agent (C), movable means for piercing or opening the container (80), characterized by distributing the defacing agent or the destructive agent (C) into the value space (30), where the value space (30) is conforming generally to an exterior shape of the drum (2), in response to triggering of said alarm by piercing or opening the container and reducing the volume of the container (80) by compressing the container into a substantially flattened configuration having substantially no volume for accommodating fluid with a compressing element; and by preventing return of the defacing agent or the destructive agent (C) into the container (80) after substantially all of the defacing agent or the destructive agent has been discharged from the container by blocking a passageway between the interior the container and the value space by the flattened container and the compressing element which acts as a seal.

2. A method according to claim 1, characterized by piercing or slitting the container (80) in response to triggering of said alarm, and compressing the container (80) with the aid of said compressing element comprising a press element or press plate (71) that acts generally over the full upper surface of the container (80) and ejecting the defacing agent or the destructive agent (C) into the space (30); and by causing the press element or the press plate (71) to be kept in its end position (E).

3. A method according to claim 2, characterized by activating movement of the press element or the press plate (71) in response to triggering of said alarm prior to said container (80) being pierced or opened.

4. The use of a method according to claim 1, characterized by applying the method in tiltable valuable document containing units (1).

5. The use of a method according to claim 2, characterized by applying the method in tiltable valuable document containing units (1).

6. The use of a method according to claim 3, characterized by applying the method in tiltable valuable document containing units (1).

7. An arrangement for defacing or destroying items, said arrangement including a drum (2) for storing items to be destroyed, said drum (2) being positioned in an alarm-equipped value space (30), wherein the arrangement (50) includes a container (80) which contains a defacing agent or a destructive agent (C) and movable means (62, 63) for piercing or opening the container (80) in conjunction with triggering of said alarm, characterized in that the arrangement (50) includes a spring activated press element or press plate (71); in that the arrangement (50) includes means (75, 76) for activating movement of the press element or the press plate (71) and a piercing or opening element (62, 63) in response to triggering of said alarm; said press element or press plate providing means for reducing the volume of the container by compressing the container into a substantially flattened configuration having substantially no volume for accommodating fluid by the press element or the press plate; and said press element or press plate preventing the return of the defacing or the destructive agent into the container after substantially all of the destructive agent or the defacing agent has been discharged from the container by, together with the flattened container, effectively forming a seal blocking a passageway between the interior of the container and the value space; and in that the value space (30) is conforming generally to an exterior shape of the drum (2).

8. An arrangement according to claim 7, characterized in that the press element or the press plate (71) has a shape and size such as to essentially cover the upper surface of the container (80).

9. An arrangement according to claim 7, characterized in that said arrangement (50) includes a conical pressure spring (72) that functions to cause the press element or the press plate (71) to move.

10. An arrangement according to claim 7, characterized in that the arrangement (50) includes a tension spring (65) which via a wire or cable arrangement (64) functions to cause the piercing or opening element (62, 63) to move.

11. An arrangement according to claim 7, characterized in that the means for activating movement of the press element or the press plate (71) and the piercing or opening element (62, 63) in response to triggering of said alarm includes a motor (75) and a linkage system (76), wherein the linkage system (76) initiates the release of a compressed conical spring (72) and an extended tension spring (65).

12. An arrangement according to claim 7, characterized in that a casing (60) of the arrangement (50) has a box-like design and includes an opening (61) for communication with the value space (30), wherein the arrangement (50) and the value space (30) are alarmed.

13. The use of an arrangement according to claim 7, characterized in that the arrangement is used in conjunction with tiltable units (1) that contain valuable items.

14. An arrangement according to claim 8, characterized in that said arrangement (50) includes a conical pressure spring (72) that functions to cause the press element or the press plate (71) to move.

15. An arrangement according to claim 8, characterized in that said arrangement (50) includes a tension spring (65) which via a wire or cable arrangement (64) functions to cause the piercing or opening element (62, 63) to move.

16. An arrangement according to claim 9, characterized in that said arrangement (50) includes a tension spring (65) which via a wire or cable arrangement (64) functions to cause the piercing or opening element (62, 63) to move.

17. An arrangement according to claim 8, characterized in that the means for activating movement of the press element or the press plate (71) and the piercing or opening element (62, 63) in response to triggering of said alarm includes a motor (75) and a linkage system (76), wherein the linkage system (76) initiates the release of a compressed conical spring (72) and an extended tension spring (65).

18. An arrangement according to claim 9, characterized in that the means for activating movement of the press element or the press plate (71) and the piercing or opening element (62, 63) in response to triggering of said alarm includes a motor (75) and a linkage system (76), wherein the linkage system (76) initiates the release of a compressed conical spring (72) and an extended tension spring (65).

19. An arrangement according to claim 8, characterized in that a casing (60) of the arrangement (50) has a box-like design and includes an opening (61) for communication with the value space (30), wherein the arrangement (50) and the space (30) are alarmed.

20. The use of an arrangement according to claim 8, characterized in that the arrangement is used in conjunction with tiltable units (1) that contain valuable items.

* * * * *

UNITED STATES PATENT AND TRADEMARK OFFICE

CERTIFICATE OF CORRECTION

PATENT NO. : 8,171,865 B2
APPLICATION NO. : 11/792785
DATED : May 8, 2012
INVENTOR(S) : Kjell Lindskog et al.

It is certified that error appears in the above-identified patent and that said Letters Patent is hereby corrected as shown below:

Column 4, Line 22 (Claim 1, Line 17): After “interior”, add --of--.

Signed and Sealed this
Nineteenth Day of June, 2012

David J. Kappos

David J. Kappos
*Director of the United States Patent and Trademark Office*